US009938943B2

(12) United States Patent
Harle et al.

(10) Patent No.: US 9,938,943 B2
(45) Date of Patent: Apr. 10, 2018

(54) DEVICE FOR DISPENSING A LIQUID ADDITIVE INTO A FUEL CIRCULATION CIRCUIT FOR AN INTERNAL COMBUSTION ENGINE, VEHICLE COMPRISING SUCH A DEVICE, AND METHOD FOR USING SAID DEVICE

(75) Inventors: Virginie Harle, Senlis (FR); Michael Lallemand, Dardilly (FR); Thierry Seguelong, La Rochelle (FR); Guy Monsallier, Granville (FR)

(73) Assignees: RHODIA OPERATIONS, Aubervilliers (FR); FILTRAUTO, Guyancourt (FR)

( * ) Notice: Subject to any disclaimer, the term of this patent is extended or adjusted under 35 U.S.C. 154(b) by 755 days.

(21) Appl. No.: 14/236,546

(22) PCT Filed: Jul. 24, 2012

(86) PCT No.: PCT/EP2012/064523
§ 371 (c)(1),
(2), (4) Date: Apr. 25, 2014

(87) PCT Pub. No.: WO2013/020805
PCT Pub. Date: Feb. 14, 2013

(65) Prior Publication Data

US 2014/0238349 A1 Aug. 28, 2014

(30) Foreign Application Priority Data

Aug. 5, 2011 (FR) ..... 11 57206

(51) Int. Cl.
*F02M 37/00* (2006.01)
*F02D 19/00* (2006.01)
(Continued)

(52) U.S. Cl.
CPC ..... *F02M 37/0047* (2013.01); *F02D 19/12* (2013.01); *F02D 41/0025* (2013.01);
(Continued)

(58) Field of Classification Search
CPC ..... F02M 37/0082; F02M 25/10; F02M 37/0047; F02M 25/00; F02M 25/14;
(Continued)

(56) References Cited

U.S. PATENT DOCUMENTS 2,795,544 A 6/1957 Henry et al.
3,392,753 A 7/1968 Kleinmann
(Continued)

FOREIGN PATENT DOCUMENTS

DE 201 02 002 4/2001
EP 0488 831 6/1992
(Continued)

OTHER PUBLICATIONS

International Search Report for PCT/EP2012/064523 dated Oct. 12, 2012.

*Primary Examiner* — Thomas Moulis
(74) *Attorney, Agent, or Firm* — B. Aaron Schulman, Esq.; Stites & Harbison, PLLC

(57) ABSTRACT

The invention relates to a device for dispensing a liquid additive into a fuel circulation circuit (2) for an internal combustion engine, in particular for an engine equipping a vehicle, said device comprising:
- a tank (26) containing the additive,
- an enclosure (24) communicating with the fuel circulation circuit (2) and inside which the tank (26) containing the additive is inserted,
- means for injecting additive connected to the tank (26) and the fuel circulation circuit (2) and making it possible to dispense the additive in the fuel circulation circuit (2), and
- control means for controlling the injection means.

37 Claims, 5 Drawing Sheets

(51) Int. Cl.
*F02M 25/10* (2006.01)
*F02D 19/12* (2006.01)
*F02D 41/00* (2006.01)

(52) U.S. Cl.
CPC ..... *F02M 25/10* (2013.01); *F02M 37/0082* (2013.01); *F02D 2200/0611* (2013.01)

(58) Field of Classification Search
CPC . F02M 25/0227; F02D 41/0025; F02D 19/12; F02D 2200/0611
USPC ..... 123/444, 445, 469, 1 A, 198 A
See application file for complete search history.

(56) References Cited

U.S. PATENT DOCUMENTS 3,720,230 A 3/1973 Miller et al.
4,621,593 A * 11/1986 Rao ..... F02B 47/00 123/1 A
4,674,458 A * 6/1987 Mori ..... F02D 41/123 123/333
6,068,672 A 5/2000 Watson et al.
6,136,048 A 10/2000 Birchem et al.
6,321,692 B1 * 11/2001 Rayner ..... F02M 25/00 123/1 A
6,659,068 B2 * 12/2003 Urushihara ..... F02B 1/12 123/295
7,459,484 B2 12/2008 Blanchard et al.
7,469,661 B2 * 12/2008 Kunstmann ..... B60K 15/00 123/1 A
8,468,982 B2 * 6/2013 Johnson ..... F01M 9/02 123/1 A
2001/0003734 A1 * 6/2001 Dunn ..... C10M 163/00 508/197
2002/0007804 A1 * 1/2002 Tichenor ..... F02M 25/00 123/1 A
2003/0136355 A1 * 7/2003 Gouzou ..... B60K 15/00 123/1 A
2006/0005465 A1 * 1/2006 Blanchard ..... B01J 13/003 44/602
2006/0201140 A1 * 9/2006 Rigaudeau ..... F01N 3/0222 60/295
2006/0254535 A1 * 11/2006 Valentine ..... F02D 33/006 123/1 A
2006/0278283 A1 * 12/2006 Gouzou ..... F02D 19/12 137/571
2007/0137514 A1 * 6/2007 Kumar ..... B61L 3/006 105/26.05
2007/0209607 A1 * 9/2007 Williams ..... F02D 19/12 123/1 A
2007/0240649 A1 * 10/2007 Freeman ..... F02D 19/12 123/1 A
2008/0022666 A1 * 1/2008 Driscoll ..... F01N 3/035 60/286
2008/0037908 A1 * 2/2008 Kunstmann ..... B60K 15/00 383/3
2008/0080682 A1 * 4/2008 Ogunwale ..... G06Q 30/02 379/93.17
2009/0235888 A1 * 9/2009 Comtat ..... F02M 25/00 123/1 A
2010/0101211 A1 4/2010 Thompson
2010/0122573 A1 * 5/2010 Tsutsumi ..... F02D 35/023 73/114.38
2010/0154739 A1 * 6/2010 Gwidt ..... F02D 41/40 123/332
2011/0146234 A1 * 6/2011 Rynders, Jr. ..... F01N 3/0275 60/274
2011/0209465 A1 * 9/2011 Novellani ..... F01N 3/2066 60/299
2011/0257871 A1 * 10/2011 Takigawa ..... F02D 41/1446 701/104
2011/0295488 A1 * 12/2011 Ramappan ..... F02D 41/2467 701/103
2012/0192823 A1 8/2012 Harle et al.
2013/0306028 A1 * 11/2013 Monsallier ..... C10L 1/02 123/434
2014/0156167 A1 * 6/2014 Lukaczyk ..... F02D 19/12 701/102
2014/0294606 A1 * 10/2014 Anderson ..... F04B 49/08 417/53
2014/0366615 A1 * 12/2014 Harle ..... F02D 41/221 73/114.77
2016/0195042 A1 * 7/2016 Isbilen ..... B01F 5/106 137/455

FOREIGN PATENT DOCUMENTS

EP 671205 9/1995
EP 1 158 148 11/2001
FR 11 55310 4/1958
JP 2012026428 * 2/2012

* cited by examiner

DEVICE FOR DISPENSING A LIQUID ADDITIVE INTO A FUEL CIRCULATION CIRCUIT FOR AN INTERNAL COMBUSTION ENGINE, VEHICLE COMPRISING SUCH A DEVICE, AND METHOD FOR USING SAID DEVICE

The technical field of the present invention is that of internal combustion engines, in particular for motor vehicles, and more particularly devices for dispensing a liquid additive in the fuel circulation circuit of the internal combustion engine.

The new engine technologies, such as diesel engines with a common rail system and very high-pressure fuel injection, a very high performing, but are nevertheless very sensitive to fuel quality.

Thus, there is a benefit in using the fuel containing additives improving its quality, in particular additives improving the dispensing of the fuel in the engine, additives for improving the running performance of the engine, and additives for improving the running stability of the engine. These are for example detergent agents, lubrication additives, or anticorrosion additives.

However, the quality of the available commercial fuels does not always make it possible to supply the engine with a fuel containing enough additives. Furthermore, fuels must meet more or less demanding standards throughout the world and therefore have a variable quality. It is therefore interesting, for optimal running of the engine, to adapt the concentration of the additive contained in the fuel.

Furthermore, to meet the new emissions control standards for vehicles, in particular diesel vehicles, vehicles are gradually being equipped with pollution reduction means of the particle filter type. This has already been the case in Europe since the advent of the Euro 5 standard. In most cases, a catalyst is used to assist with burning soot periodically and thereby regenerating the particle filter. The use of a particle filter regenerating additive, vectorized by the fuel supplying the engine or fuel borne catalyst (FBC), has proven to respond to many criteria, since it makes it possible to generate a particle filter more quickly and at a lower temperature than the competing technology, called catalyzed soot filter (CSF).

It is therefore interesting to equip vehicles with a device making it possible to insert, into the fuel, an additive for assisting with the regeneration of the particle filter and/or fuel additives improving the quality of the fuel and/or the running of the engine and/or its durability.

It is known that systems exist making it possible to introduce such additives into the fuel, in particular FBC catalytic additives assisting with particle filter regeneration. These systems are generally based on a large tank with a minimum volume of 2 to 3 liters containing the additive tank and which must be installed in areas close to the fuel tank.

The additive is generally then metered using high-precision metering pumps controlled using an additional electronic control unit (ECU). This metering device is managed precisely so as to ensure a sufficient additive content level in the fuel to allow proper regeneration of the particle filter, but not too much so as to avoid premature dirtying of the particle filter through the mineral regeneration residues of the particle filter that remained collected within it.

Traditionally, when the fuel level increases in the tank, following the addition of fuel, a computer indicates the quantity of fuel to be injected into the tank to the pump so as to maintain a constant additive concentration in the fuel at all times.

These extremely precise metering pumps, as well as the ECU management, significantly increase the cost of these additive dispensing devices.

Furthermore, the use of such an additive dispensing device means enslaving the additive metering system and checking that it is functioning properly, which remains particularly intrusive in management fault modes of the vehicle.

In terms of maintenance, filling the tank is somewhat difficult, in particular because it is often done through a complex connection. Furthermore, depending on the location of the tank, it may also be difficult to access.

A device for dispensing a liquid additive in a fuel circulation circuit for an internal combustion engine of a vehicle has been protected by the applicant under filing number FR 11 00316. This device includes:

- a tank containing the additive,
- an enclosure communicating with the fuel circulation circuit and inside which the tank containing the additive is contained, at least one moving and sealed wall between said enclosure and said tank providing sealed separation on the one hand and maintaining an identical pressure between the additive in the tank and the fuel in the enclosure on the other hand,
- additive dispensing means connected to the tank and the fuel circulation circuit and making it possible to dispense the additive in the fuel circulation circuit, said means comprising a dispensing channel connecting the tank and the fuel circulation circuit.

Likewise, the applicant has also protected the integration of a device for dispensing a liquid additive in a fuel tank under filing number FR 11 55310.

Such devices are easy to implement and are more cost-effective than the high precision dosing pumps currently used.

However, such devices do not make it possible to adapt the additive contribution, in particular to the travel conditions of the vehicle.

One of the aims of the invention is to propose a dispensing device as described above making it possible to extend the autonomy of the additive tank while limiting or even stopping the contribution of additive so as to avoid an excessive concentration of additive in the fuel under certain conditions.

One of the aims of the invention is also to optimize the additive concentration in the fuel source to find a compromise between the necessary sufficient quantity and an over-concentration that may reduce the autonomy of the additive tank and/or have negative repercussions on other members of the vehicle, such as dirtying the particle filter.

Likewise, the invention aims to optimize the additive injection such that the injection only occurs when the vehicle needs it, in particular based on the travel conditions and/or the quantity of fuel.

To that end, the invention relates to a device for dispensing a liquid additive in a fuel circulation circuit for an internal combustion engine, in particular for an engine equipping a vehicle, said device comprising:

- a tank containing the additive,
- an enclosure communicating with the fuel circulation circuit and inside which the tank containing the additive is inserted, at least one movable sealing wall between said enclosure and said tank providing a sealing separation on the one hand and maintaining an identical pressure between the additive in the tank and the fuel in the enclosure on the other hand, means for injecting the additive connected to the tank and the fuel circulation circuit and making it possible to dispense the additive in the fuel circulation circuit, said means including a dispensing channel connecting the tank and the fuel circulation circuit, and means for controlling the injection means, characterized in that the control means are associated with:

means for analyzing at least one parameter representative of the use of the vehicle; and/or means for analyzing the travel conditions of vehicle, and/or means for analyzing the evolution of the quantity of fuel contained in a fuel tank, said tank being accessible to a user so as to add fuel, and/or means for analyzing the quality of the fuel, and/or means for analyzing the polluting emissions resulting from the combustion of the fuel in the engine and/or means for analyzing the quality of the regeneration of a particle filter positioned in the exhaust line of the engine, and/or means for analyzing the type of additive used, and/or means for analyzing the evolution of the additive flow rate dispensed in the fuel circulation circuit, and/or means for analyzing climate conditions, to monitor the operation of the injection means.

The dispensing device according to the invention may comprise one or more of the following features:

the injection means may include means for closing off the dispensing channel, the closing off means being suitable for completely or partially closing off the dispensing channel, the closing off means in particular being of the valve or solenoid valve type;

the dispensing device may include a temperature sensor intended to indicate the temperature of the fuel in the fuel circulation circuit, in particular near the dispensing channel, and/or of the additive, the temperature of the additive and/or the fuel constituting a parameter representative of the evolution of the additive flow rate and/or the use of the vehicle and/or climate conditions;

the dispensing device may include a temperature sensor outside the vehicle, the outside temperature constituting a parameter representative the climate conditions;

the dispensing device may include a sensor detecting the turning on of the vehicle and/or an element belonging to the fuel circulation circuit, in particular a fuel filter, the turning on constituting a parameter representative of the use of the vehicle;

the dispensing device may comprise pressure sensors measuring the pressure at an additive dispensing orifice positioned at one end of the dispensing channel situated at the fuel circulation circuit, and at an inlet orifice for the fuel positioned upstream from the dispensing orifice in the circulation circuit, a pressure difference between the orifices constituting a parameter representative of the use of the vehicle and/or the evolution of the additive flow rate and/or the travel conditions;

the dispensing device may comprise a noise sensor positioned preferably near the engine, the detection of noise by the sensor constituting a parameter representative of the use of the vehicle;

the dispensing device may include location means of the GPS type or a movement sensor, the detection of movement by the location means or the movement sensor constituting a parameter representative of the use of the vehicle and/or the travel conditions of the vehicle;

the average speed and/or instantaneous speed of the vehicle may constitute a parameter representative of the travel conditions of the vehicle;

the temperature of the exhaust gases may constitute a parameter representative of the travel conditions of the vehicle;

the evolution of the pressure in the circulation circuit, in particular in a high-pressure circuit of the vehicle made up of a high-pressure pump and a shared injection ramp, may constitute parameter representative of the travel conditions of the vehicle;

the evolution of the air flow rate supplying the combustion chamber of the engine may constitute a parameter representative of the travel conditions of the vehicle;

the evolution of the fuel flow rate in the circulation circuit may constitute a parameter representative of the evolution of the additive flow rate;

the evolution of the emissions of NOx, soot or other carbon particles or the NOx/soot and/or NOx/particle ratios may constitute parameters representative of the polluting emissions resulting from the combustion of the fuel;

the evolution of the quality and/or quantity of oil allowing lubrication of the engine may constitute a parameter representative of the evolution of the quality of the regeneration of the particle filter positioned in the exhaust line of the engine;

the dispensing device may comprise a location means of the GPS type indicating the geographical area in which the vehicle is located, the location of the vehicle provided by the means constituting a parameter representative of the quality of the fuel marketed in the geographical area;

parameters representative of the combustion of the fuel in the cylinders of the engine may constitute a parameter representative of the quality of the fuel;

the fuel consumption of the engine may constitute a parameter representative of the travel conditions of the vehicle;

the additive may be a particle filter regenerating additive with a base of a rare earth and/or a metal chosen from groups IIA, IVA, VITA, VIII, IB, IIB, IIIB and IVB of the periodic table;

the additive may assume the form of a colloidal dispersion;

the particles of the colloidal dispersion may have a base of cerium and/or iron;

the additive may be a combination of a colloidal particle dispersion that includes an organic phase and at least one amphiphilic agent and a detergent;

the additive may be an additive allowing the improvement of the dispensing of fuel in the engine and/or the improvement of the running performance of the engine and/or the improvement of the running stability of the engine;

the additive may be a combination of a detergent additive and a lubrication additive.

The invention in particular applies to combustion engines using gasoline or diesel as fuel.

Likewise, engines equipped with a device according to the invention may equip stationary facilities, or so-called "off-road" vehicles, such as construction vehicles, or so-called "on road" vehicles, such as motor vehicles.

The invention also relates to a motor vehicle comprising:

a fuel circulation circuit for an internal combustion engine of the vehicle, a tank containing a liquid additive, an enclosure communicating with the fuel circulation circuit and inside which the tank containing the additive is inserted, at least one moving sealing wall between said enclosure and said tank ensuring sealed separation on the one hand and maintaining an identical pressure between the additive in the tank and fuel in the enclosure on the other hand, means for injecting the additive that are connected to the tank and the fuel circulation circuit and that make it possible to dispense the additive in the fuel circulation circuit, said means comprising a dispensing channel connecting the tank and the fuel circulation circuit, characterized in that the additive is injected using a dispensing device according to the invention.

The invention also relates to a method for using a dispensing device according to the invention for which dispensing of the additive is stopped when the engine of the vehicle is no longer running or when the vehicle is stopped.

The invention also relates to a method for using a dispensing device according to the invention for which the additive dispensing is activated when the closing off means is powered on.

The invention also relates to a method for using a dispensing device according to the invention for which the dispensing of additive is activated when a pressure difference greater than 2 mbar is measured between the additive dispensing orifice positioned at one end of the dispensing channel and the fuel inlet orifice positioned upstream in the circulation circuit on the other hand.

The invention also relates to a method for using a dispensing device according to the invention for which the additive dispensing is activated when the temperature of the fuel circulating in the circulation circuit and/or of the additive is above a threshold value representative of a running engine, for example greater than 15° C.

The invention also relates to a method for using a dispensing device according to the invention for which the additive dispensing is stopped when the outside temperature and/or the temperature of the additive and/or the temperature of the fuel in the fuel circulation circuit are below a minimum threshold temperature or above a maximum threshold temperature, said minimum and maximum threshold temperatures being defined for a given additive, the minimum threshold temperature being able to correspond to a value for which the viscosity of the additive reaches a threshold value and the maximum threshold temperature being able to correspond to the vaporization value of the additive.

The invention also relates to a method for using a dispensing device according to the invention for which the injection is discontinuous and in that the frequency and/or opening time of the closing off means depend on information collected by the control means, the dispensing of additive being done so as to preserve a constant additive concentration in the fuel or to inject the additive in the fuel circulation circuit only when necessary.

According to a first embodiment, the dispensing frequency and/or the dispensing duration of the additives depend either on the usage time of the vehicle and/or on the number of kilometers traveled by the vehicle and/or the fuel consumption of the vehicle.

According to a second embodiment, the frequency and/or duration of additive dispensing depend on the temperature of the fuel and/or the additive, and/or on the pressure between the additive dispensing orifice positioned at one end of the dispensing channel and the fuel inlet orifice positioned upstream in the circulation circuit.

The invention also relates to a method for using a dispensing device according to the invention for which the additive is injected each time fuel is added in the fuel tank, the volume of said additive being able to be fixed or variable, the variable volume being determined based on the quantity of fuel added.

The invention also relates to a method for using a dispensing device according to the invention for which the additive is injected when the analysis of the polluting emissions resulting from the combustion of the fuel indicates that the gases and/or particles emitted diverge from the theoretical expected value.

The invention also relates to a method for using a dispensing device according to the invention for which the additive is injected before regenerating the particle filter.

The invention also relates to a method for using a dispensing device according to the invention for which an additional quantity of additive is injected before the regeneration of the particle filter when the previous regeneration was not of good quality.

The invention will be better understood upon reading the following description, provided solely as an example and done in reference to the appended drawings, in which.

Figure 1:
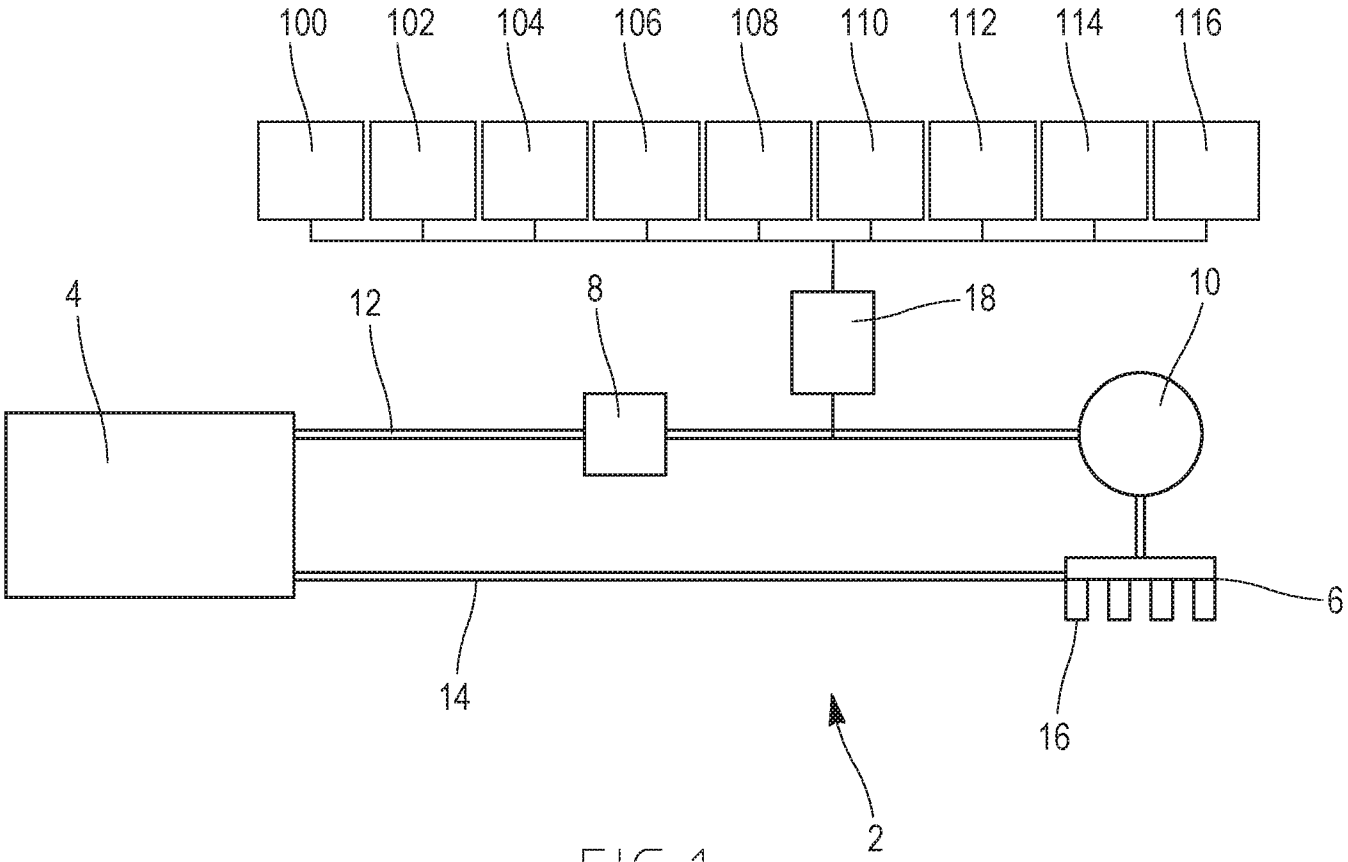
FIG. 1 is a diagrammatic illustration of a device for dispensing an additive in a fuel circulation circuit of an internal combustion engine.

FIG. 1 diagrammatically illustrates a fuel circulation circuit 2 for a motor vehicle internal combustion engine.

Traditionally, the fuel circulation circuit 2 is positioned between a fuel tank 4 and a high-pressure rail 6 (also called "common rail") and ensures the circulation of the fuel between the tank and the high-pressure ramp, and optionally the return of the fuel toward the tank 4.

The circulation circuit includes a filter 8 for filtering the fuel and a high-pressure pump 10. The high-pressure pump 10 and the high-pressure ramp 6 make up the fuel injection system.

A first conduit 12, called "supply line", ensures the circulation of fuel from the tank 4 toward the high-pressure ramp 6, and a second conduit 14, called "return line", ensures the circulation of fuel from the injection system toward the tank 4. The fuel is therefore pumped into the tank 4, then filtered in the filter 8 and sent pressurized, by means of the pump 10, into the high-pressure ramp 6, then a portion is oriented toward the injectors 16 of the engine, and another portion is returned to the tank 4 by the return line 14. A portion of the fuel may also be sent from the high-pressure pump 10 to the return line 14.

The fuel circulation circuit 2 also includes a device 18 for dispensing a liquid additive according to the invention, the operation of which will be described later. As an illustration and non-limitingly, the additive dispensing device 18 has been shown on the supply line 12, but the additive dispensing device 18 may also be positioned on the fuel return line 14.

Figure 2:
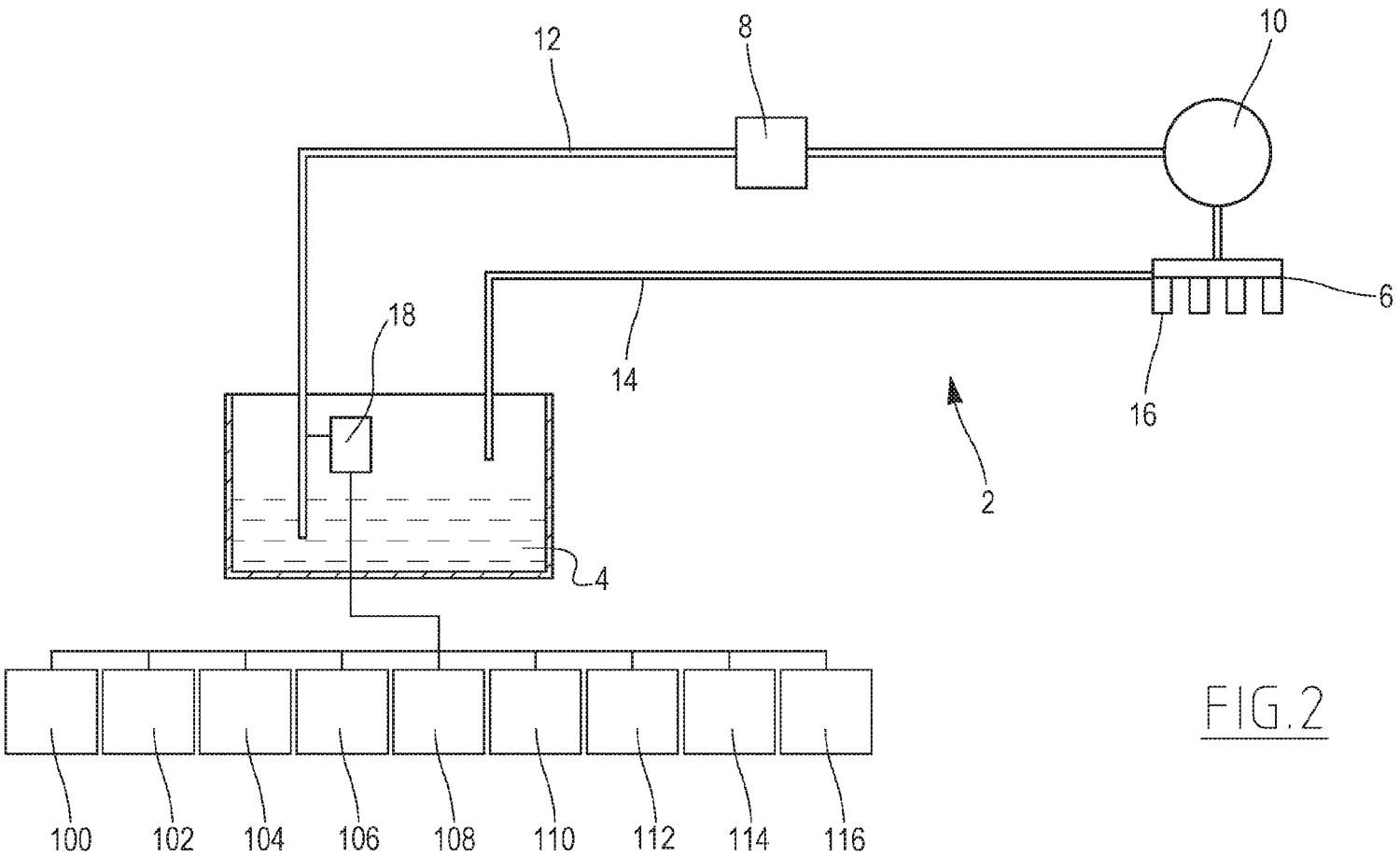
FIG. 2 is a diagrammatic illustration identical to that of FIG. 1, the additive dispensing device being positioned in a fuel tank.

Alternatively, as shown in FIG. 2, the additive dispensing device 18 may also be positioned in the fuel tank 4.

In this embodiment, the fuel circulation circuit 2 ensures the circulation of the fuel between the inside of the fuel tank 4 and the engine, and optionally the return of the fuel toward the tank 4. Thus, the part of the fuel circulation circuit 2 bearing the dispensing device 18 extends inside the fuel tank 4.

Figure 3:
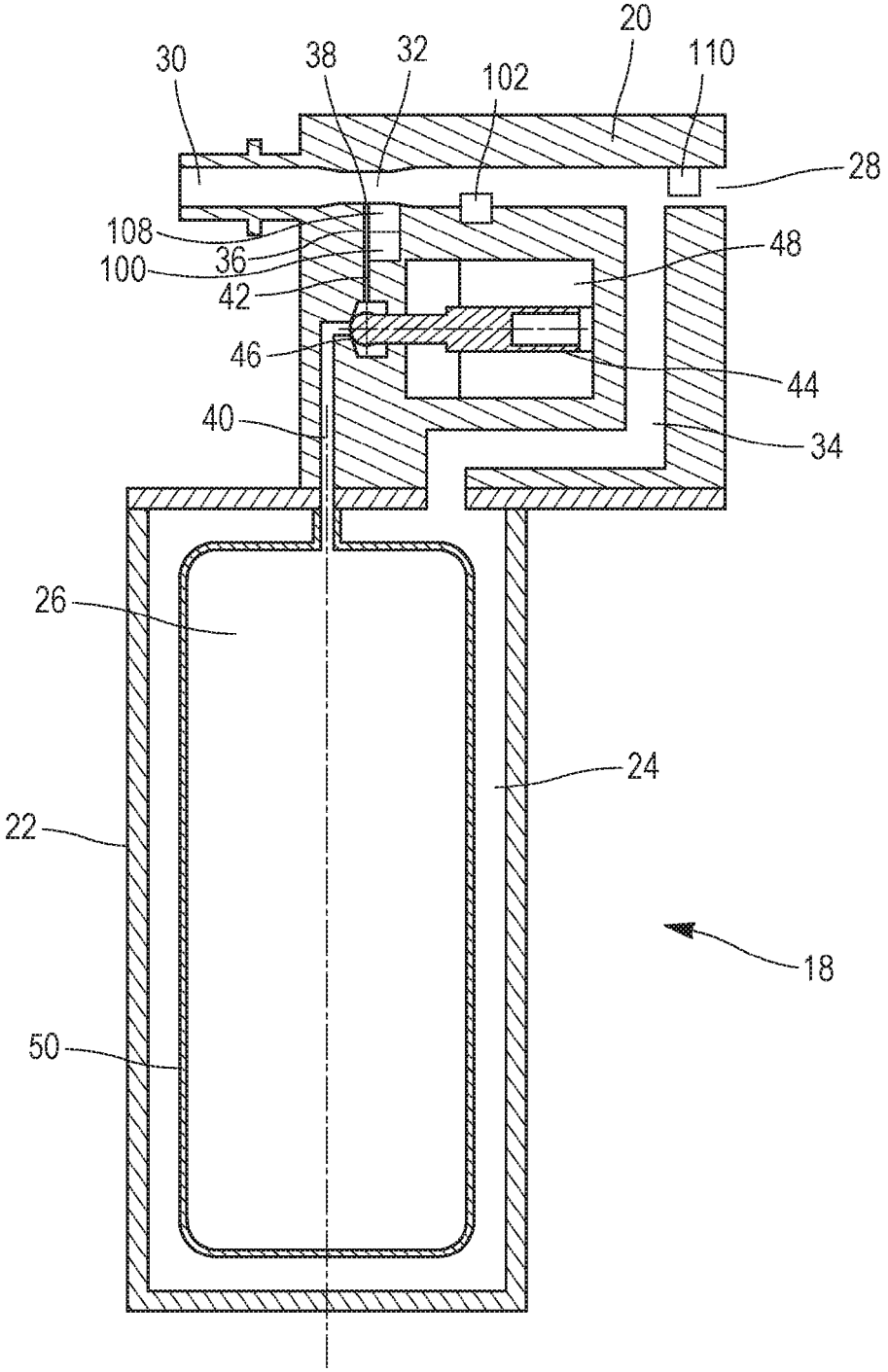
FIG. 3 is a cross-sectional view illustrating a liquid additive dispensing device.

FIG. 3 shows a cross-sectional view of one example embodiment of a dispensing device 18. In this example embodiment, the device 18 for dispensing an additive comprises a head 20 and a replaceable cartridge 22 forming an additive enclosure 24 in which a liquid additive tank 26 is positioned. The head 20 includes a fuel inlet orifice 28, a fuel outlet orifice 30, a venturi 32 situated between the fuel inlet 28 and outlet 30 orifices, a conduit 34 providing a fuel passage between the fuel inlet orifice 28 and the additive enclosure 24 inside the replaceable cartridge 22, and an additive dispensing channel 36 ensuring the passage of the liquid additive from the tank 26 toward an orifice 38 for dispensing additive in the venturi 32.

In this example embodiment, the additive dispensing channel 36 has a first portion 40 and a second portion 42 with a reduced section. An actuator 44, made up of a finger 46 and a coil 48, makes it possible to close off the passage between the portions 40 and 42 of the additive dispensing channel.

In this example embodiment, the additive tank 26 assumes the form of a flexible pouch 50 making up a moving sealing wall between the fuel present in the additive enclosure 24 and the additive inside the tank 26.

The operation of the invention is as follows:

The additive dispensing device 18 is connected to the circulation circuit 2. The fuel therefore circulates continuously between the fuel inlet and outlet orifices 28 and 30.

The venturi 32, which constitutes a known means for generating a pressure difference, generates a vacuum between the additive dispensing orifice 38 and the fuel inlet orifice 28.

The additive enclosure 24, communicating through the conduit 34 with the fuel inlet orifice 28, is filled with fuel at the same pressure as the fuel circulating at the fuel inlet orifice 28, and the flexible pouch 50, making up the moving sealing wall of the additive tank, maintains an identical pressure between the additive in the additive tank 26 and the fuel in the enclosure 24.

The pressure in the additive tank 26 is therefore greater than the pressure prevailing at the additive dispensing orifice 38, which forces the additive to move from the tank 26 through the additive dispensing orifice 38, then to be dispensed in the fuel circulating in the venturi 32 and therefore in the fuel circulation circuit.

The actuator 44 makes it possible to completely or partially prevent the circulation of the additive.

In this example embodiment, the actuator 44 illustrates an electromechanical means for completely or partially closing off the additive dispensing channel, but a valve or solenoid valve may for example also be used. In the rest of the description, these different means will be called closing off means.

Furthermore, pollution eliminating means, such as a catalyzed or non-catalyzed particle filter (not shown), may be positioned in the exhaust line of the vehicle.

Catalyzed soot filters, called CSF, generally contain a catalyst directly or indirectly assisting with the regeneration of the particle filter whereof the pores of the filtering walls are coated. These CSF-type particle filters may in particular contain precious metals, such as platinum and/or palladium. However, under certain travel conditions, the regeneration of these CSF particle filters may be improved using an additive injected into the fuel.

Hereinafter, the term "particle filter" will be used indifferently to refer to a non-catalyzed particle filter or a catalyzed particle filter.

The control of the closing off means aiming to monitor the additive flow rate dispensed in the dispensing circuit will now be described in more detail, the different control modes being grouped together based on the purpose they seek to fulfill.

The control aims to inject the additive discontinuously and thereby makes it possible to control the closing off/opening frequency of the dispensing channel 36 and/or the amplitude of the opening and/or closing durations, and/or to modulate the degree of closing off in the case of partial closing off means.

First Control Mode

The purpose of this first control mode is to minimize the additive concentration fluctuations in the fuel, in particular in the fuel tank 4.

Thus, this first control mode aims to detect the stop periods of the vehicle and interrupt the dispensing of additive when such periods are detected.

This first control mode also makes it possible to interrupt the dispensing of the additive in the circulation circuit during certain periods of the lifetime of the vehicle with the aim of using the additive wisely and/or preventing the tank containing the additive from emptying too quickly.

Thus, in this first control mode, additive dispensing may by interrupted when it is detected that the vehicle's engine has been stopped. This makes it possible to avoid excess additive in the fuel while the vehicle is parked and is therefore not consuming the injected additive. Such a stoppage of the additive dispensing makes it possible to increase the autonomy of the additive tank.

Furthermore, when the additive used is intended to help regenerate a particle filter positioned in the exhaust line of the vehicle (examples of additives will be provided later), it is also interesting to limit the additive concentration in the fuel so as not to clog the channels of the particle filter too quickly with the mineral residues from the additive. The control of the additive dispensing in this case aims to ensure that the concentration is comprised between a minimum value, for which the regeneration of the particle filter is facilitated, and a maximum value, beyond which the channels of the particle filter become clogged quickly.

In order to carry out this first control mode, the dispensing device according to the invention may include means for analyzing at least one parameter representative of the use of the vehicle, such as means for detecting that the engine is running and/or aiming to indicate whether the vehicle is in motion. For example, the dispensing device includes a sensor 106 detecting the turning on of the vehicle.

In particular, these means may be suitable for detecting the powering on of the fuel filter and/or the closing off means of the dispensing channel, and/or more generally the powering on of the vehicle.

These means may also include a temperature sensor 102 suitable for detecting the temperature of the additive and/or a temperature sensor 100 suitable for detecting the temperature of the fuel circulating in the fuel circulation circuit. In fact, when the engine is running, these temperatures are above a threshold value, for example greater than 15° C.

Likewise, these means may comprise pressure sensors 108, 110 seeking to measure respectively the pressure at the additive dispensing orifice 38 and at the fuel inlet orifice 28; when the pressure difference between these two orifices is above a threshold value, generally above 2 mbar, it is an indication of circulation of the fuel and thus running of the engine.

Figure 4:
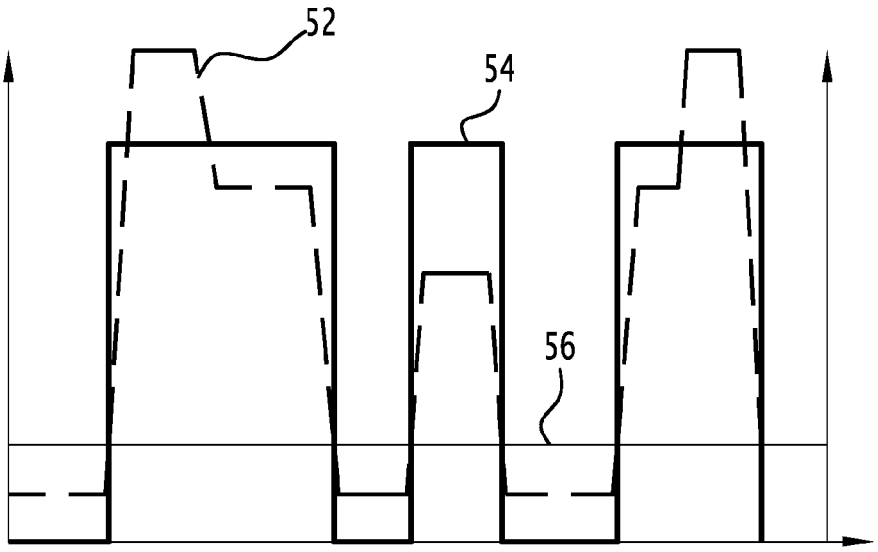
FIGS. 4 to 7 illustrates different strategies for opening/closing a closing off means monitoring the additive dispensing in the fuel circulation circuit.

FIG. 4 illustrates this operating mode. Curve 52 of this figure shows an example of the evolution as a function of time of the pressure difference between the orifices 38 and 28, the time being shown along the X axis. Curve 54 shows the evolution as a function of time of the status of the closing off means depending on the pressure difference, the line portion positioned at the X axis showing the closed state of the closing off means, while the line portion positioned away from the X axis represents the open state of the closing off means. The curve 56 shows the activation threshold, the closing off means being closed for a value of the pressure difference below that threshold and open at a value of the pressure difference above that threshold. Thus, as long as the pressure difference exceeds the activation threshold, the closing off means remains open so as to allow the addition of additive, the addition of additive being stopped once the pressure difference assumes a value below the predetermined threshold value.

An identical curve can be obtained when the control is done using a threshold temperature value activating the opening/closing of the closing off means.

Likewise, these means may comprise a geolocation means 114 of the GPS type or a motion sensor 116 indicating the movement of the vehicle.

Likewise, these means may include a noise sensor 112 positioned near the engine, the detection of noise by said sensor constituting a parameter representative of the use of the vehicle.

Preferably, in this first control mode, a closing off means making it possible to completely close off the dispensing channel is used, for example a thermal valve, an "umbrella" valve, a check valve, a hydraulic or electromechanical control valve, or a solenoid valve.

Second Control Mode

The purpose of this second control mode is to interrupt the dispensing of additive when the conditions, in particular climate conditions, are not favorable therefor.

To that end, a temperature sensor 102 aiming to acquire the temperature of the additive and/or a temperature sensor 100 to acquire the temperature of the fuel in the fuel circulation circuit, in particular positioned near the dispensing device 18, may be used.

Once the temperature sensor 100, 102 detects a temperature below a minimum threshold value or a temperature above a maximum threshold value, the dispensing device interrupts the dispensing of additive in the circulation circuit.

Depending on the additive used, the minimum threshold temperature may correspond to that temperature at which the additive has an excessive viscosity or at which the additive reaches its cloud point or solidifies; the maximum threshold temperature may correspond to the vaporization value of the additive, the minimum and maximum threshold temperatures being defined for a given additive.

Alternatively, an outside temperature sensor 104 can be used. This alternative is particularly interesting when the dispensing device 18 is positioned in the fuel tank 4. In fact, in this configuration, the dispensing device 18 is more sensitive to outside temperature variations.

This second control mode seeks to avoid any deterioration of the dispensing device and/or the circulation circuit created by the additive, the physical state of which has changed. In fact, when the temperature is for example below the minimum threshold temperature, an excessive viscosity of the additive may in particular clog the additive dispensing channel 36.

Third Control Mode

The purpose of this third control mode is also to minimize the additive concentration fluctuations in the fuel.

In the third control mode, the dispensing of additive is done so as to minimize the additive concentration fluctuations in the fuel following the fluctuations of parameters outside the device that may cause the additive concentration to vary.

In this third control mode, the opening frequency and/or duration of the closing off means do not depend on the running of the engine. Thus, even when the engine is running, the additive dispensing may be interrupted.

For a given additive and a given dispensing device, this third control mode seeks to correct the fluctuations due in particular to the evolution of the quantity of fuel in the vehicle's fuel tank. This evolution may be related on the one hand to the travel conditions of the vehicle when the engine is running, and in particular the fuel consumption, the latter being continuous but variable over time, and on the other hand the addition of fuel into the tank by the user, creating an abrupt increase in the quantity of fuel in the tank.

As in the first control mode, the control may be done by controlling the opening/closing of the closing off means either from parameters generated autonomously by the device, or from outside parameters for example provided by the electronic control unit (ECU) of the vehicle, the control consisting of adapting the frequency and/or opening duration and/or opening amplitude of the closing off means to make it possible to adapt either the quantity of additive introduced upon each injection, or the time interval between each injection, the injected quantity then being identical.

Different control alternatives may be considered in order to preserve a substantially constant average additive concentration in the fuel tank and/or to reduce the minimum and maximum fluctuations of that concentration.

A first alternative consists of injecting additive at a regular frequency, the dispensing duration of the additive being constant during each dispensing period.

The dispensing frequency and duration will be assessed based on the average fuel consumption of the vehicle established by the builder of the vehicle and/or the size of the fuel tank, these two parameters being known during the design of the vehicle.

According to this first alternative, the frequency may either be time-based, for example by injecting additive into the circulation circuit every hour, or dependent on the number of kilometers traveled by the vehicle, for example by injecting additive every 100 km. To that end, the distance traveled by the vehicle may be recovered either locally by a GPS chip or any other geolocation system installed in the dispensing device, or by recovering the data from the ECU or GPS of the vehicle.

A second alternative consists of injecting additive at a variable frequency, the dispensing duration of the additive also being able to vary from one dispensing period to another.

The dispensing frequency and/or duration are adjusted based on the average consumption of the vehicle. To that end, the average consumption of the vehicle may be obtained by recovering the data from the ECU of the vehicle.

With respect to the first alternative, this second alternative has the advantage of being more precise by adapting the quantity of additive to be injected to the actual consumption of the vehicle.

A third alternative consists of injecting additive each time fuel is injected into the vehicle's tank, the dispensed quantity of additive being constant during each dispensing period.

This additive addition may be done once opening of the fuel hatch allowing filling of the tank is detected or once a signal from the ECU of the vehicle indicates that the fuel volume in the tank has increased.

The quantity of additive to be injected, and therefore the injection time, may be calculated considering a standard fuel addition in the tank. It is considered that the user does not wait to empty his vehicle's tank completely before filling it. Thus, for example, for a tank that contains a total of 60 L, the quantity of injected additive will be evaluated so as to enrich 40 L of fuel.

A fourth alternative consists of injecting additive each time fuel is added into the tank of the vehicle, the dispensed quantity of additive varying upon each dispensing period based on the quantity of fuel added.

This alternative makes it possible to adjust the quantity of additive to the quantity of fuel actually introduced during the addition of fuel in the tank. This additive addition may be done when the signal from the ECU of the vehicle indicates that a certain quantity of fuel has been added to the tank, the quantity of additive and therefore the dispensing time being adapted to the quantity of fuel added.

Figure 5:
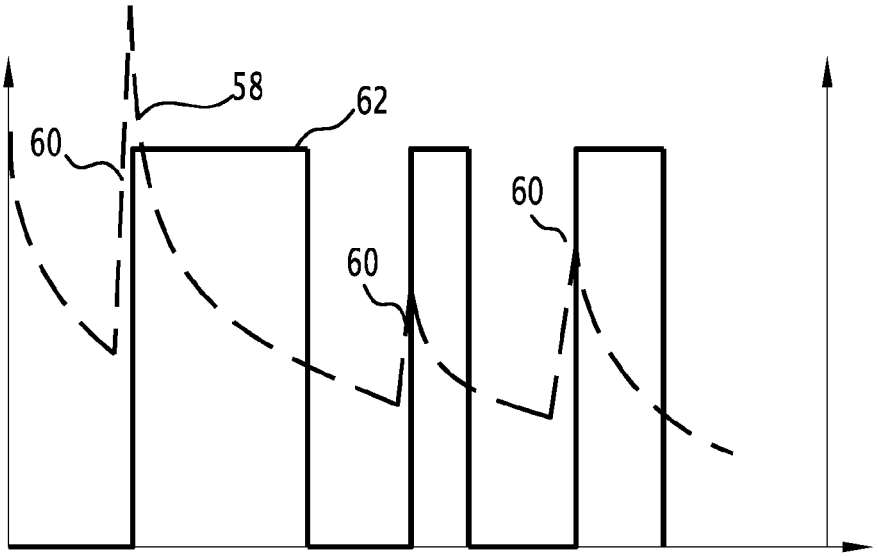

FIG. 5 illustrates this operating mode. Curve 58 of that figure shows an example of the evolution as a function of time of the volume of fuel in the tank 4, the time being shown along the X axis. Each abrupt increase referenced 60 corresponding to an addition of fuel in the tank. Curve 62 shows the evolution as a function of time of the state of the closing off means based on the volume of fuel added, the line portion positioned near the X axis representing the closed state of the closing off means, while the portion of the line positioned away from the X axis represents the open state of the closing off means.

Thus, when the fuel level is stabilized in the tank, the quantity of fuel added is calculated so as to determine the quantity of additive to be added, which makes it possible to calculate the opening time of the closing off means to deliver a quantity of additive proportional to the quantity of fuel added.

Here, FIG. 5 illustrates three successive variable-volume fuel additions, corresponding to the addition of the volume V for the first addition, one third of that volume V for second addition, and half of that volume V for the third addition, respectively. As shown in FIG. 5, each opening duration of the closing off means is then proportional to the added volume and corresponds to a duration T, one third of that duration T, and half of that duration T, respectively.

Likewise, the additive concentration fluctuations in the fuel of the tank may be related to a variation of the additive flow rate following a variation of the temperature prevailing in the circulation circuit and/or a variation of the fuel flow rate in the circulation circuit.

In fact, the temperature affects the viscosity of the additive and can therefore modify the flow rate of the additive when it is dispensed. Thus, generally, an increase in the temperature reduces the viscosity and density of the additive and causes an increase in the mass flow rate of additive. The origin of this fluctuation may in particular be related to the temperature of the air surrounding the dispensing device, the position of the dispensing device in the vehicle or the temperature of the fuel, the temperature variations of the fuel circulation system traditionally, for motor vehicles, being able to vary from ambient temperature, which varies by season, up to temperatures typically reaching 120° C.

The same is true for fuel whereof the density and viscosity are affected by the evolution of the temperature in the circulation circuit. These modifications may lead to a substantial evolution of the additive concentration in the fuel, the variations of the density and viscosity of the fuel as a function of temperature being well known.

Advantageously, a temperature sensor 100 installed at the dispensing device makes it possible to determine the temperature of the fuel circulating in the device. According to the temperature value, the duration and/or frequency of injection and/or the amplitude of the closing off means may be adapted.

Figure 6:
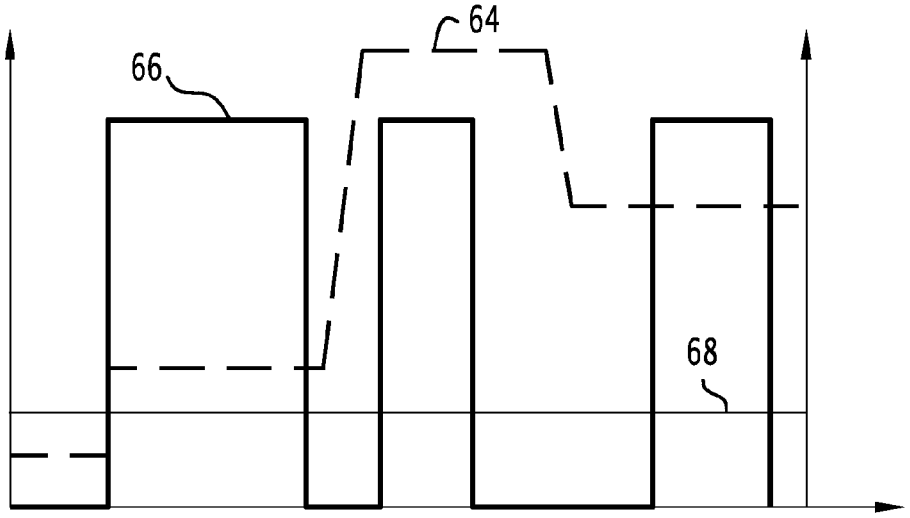

FIG. 6 illustrates this operating mode. Curve 64 in this figure shows an example of evolution as a function of time of the temperature measured at the dispensing device, the time being shown along the X axis. Curve 66 shows the evolution as a function of time of the state of the closing off means depending on the measured temperature, the line portion positioned close to the X axis representing the closed state of the closing off means, while the line portion positioned away from the X axis represents the open state of the closing off means. Curve 68 shows the activation threshold, the closing off means being closed at a temperature value below that threshold and open at a temperature value above that threshold. Thus, the addition of additive is only allowed when the temperature has a value above the predetermined threshold value.

As shown, this control mode is adapted to account for the evolution of the physicochemical characteristics of the fuel and the additive with the temperature. In this example, the additive used has a viscosity that increases as the temperature decreases. Thus, the closing off means is opened regularly and each injected dose of additive is adapted to the measured temperature, the opening duration being longer as the temperature is lower.

Likewise, the flow rate of the fuel in the circulation circuit can vary, in particular for vehicles equipped with a low-pressure fuel pump, where the flow rate is variable to make it possible to save energy when the fuel consumption is lower. Variable flow rate pumps for example make it possible to have flow rates of 110 l/h +/−50 l/h in the case of an individual vehicle engine (typically 2 l per cylinder).

The fuel flow rate fluctuations cause a fluctuation in the pressure difference between the additive dispensing orifice 38 and the fuel inlet orifice 28, which affects the additive flow rate. Thus, an increase in the fuel circulation flow rate causes an increase in the pressure difference between the additive dispensing orifice 38 and the fuel inlet orifice 28, which causes an increase in the additive injection flow rate.

Advantageously, pressure sensors 110, 108 respectively installed at the orifices 28 and 38 make it possible to monitor the fuel flow rate fluctuations and therefore to know the evolution of the additive flow rate in the dispensing circuit. The injection duration and/or frequency may be adapted based on the values collected by the sensors.

Figure 7:
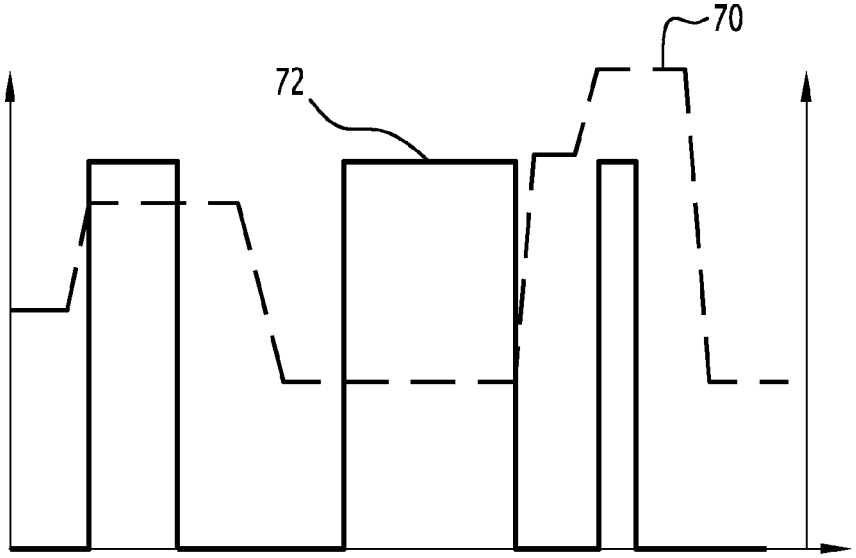

FIG. 7 illustrates this operating mode. Curve 70 of this figure shows an example of the evolution as a function of time of the pressure difference between the orifices 38 and 28, the time being shown along the X axis. Curve 72 shows the evolution as a function of time of the closing off means based on the pressure difference, the line portion positioned at the X axis representing the closed state of the closing off means, while the line portion positioned away from the X axis represents the open state of the closing off means.

In this example, the closing of means is opened regularly. The opening time of the closing off means is inversely proportional to the measured pressure difference, which makes it possible to compensate the impact of a variable fuel circulation flow rate and thus to ensure the absence of fluctuation of the additive flow rate when the fuel circulation flow rate is variable.

One of the advantages of this third control mode is being able to dispense the additive with a greater flow rate over a shorter amount of time, the additive dispensing being blocked the rest of the time by the closing of the closing off means. It is thus possible to use a dispensing device whereof the dimensions, in particular of the means making it possible to generate a pressure difference at the additive dispensing channel, such as the venturi, are larger. Likewise, the dimensions of the dispensing channel 36 can be increased. This makes it possible to monitor the quantity of additive dispensed in the circulation circuit more precisely.

Preferably, in this third control mode, a closing off means will be used making it possible to close off the dispensing channel completely.

Advantageously, it is possible to couple the different example embodiments described in the first, second and third control modes.

For example, it is possible to monitor the temperature prevailing in the circulation circuit and the variation of the fuel flow rate in the circulation circuit between the additive dispensing orifice 38 and the fuel inlet orifice 28, so as to adapt the duration and/or frequency of additive injection.

Likewise, it is possible to have, for a same vehicle, means aiming to detect stops of the vehicle so as to interrupt the dispensing of additive when the vehicle is stopped, means aiming to identify the quantity of fuel in the tank so as to inject additive into the circulation circuit following an addition of fuel, means aiming to track the evolution of the temperature in the dispensing device, and means aiming to track the evolution of the fuel flow rate in the circulation circuit, so as to adapt the opening frequency and/or duration of the closing off means so that the additive concentration remains substantially constant in the fuel tank.

Fourth Control Mode

The purpose of this fourth control mode is to inject additive into the circulation circuit only when necessary, which may in particular be done so as to adjust the additive concentration to the current needs of the vehicle. Thus, the injection of additive may occur at regular intervals, such as every minute, every hour, or each time the tank is filled, or at predetermined travel intervals, for example, every 100 km.

Thus, only an additive dose necessary for proper running of the vehicle is dispensed into the circulation circuit. In this control mode, the additive concentration evolves deliberately over time, the frequency and/or duration of opening of the closing off means being adapted based on the quantity of additive to be injected.

Preferably, and as will be outlined hereinafter, the dose of additive delivered may depend on the travel and usage conditions of the vehicle, or on the type of fuel used.

Preferably, the example embodiments of the fourth control mode may be coupled with one or more of the example embodiments previously described and belonging to the first, second and third control modes.

Fuel Quality

In the event the additive used aims to improve the properties of the fuel, in particular to stabilize the fuel used or to reduce the effects of its deterioration on the engine or the fuel circulation circuit or to improve its combustion properties (examples of additives will be provided later), an additional additive injection may be done when it is detected that the engine is being supplied with a fuel of mediocre or unsuitable quality. Thus, the quantity of additive to be added will depend on the quality of the fuel used, a lower quality fuel generally requiring a larger quantity of additive.

In fact, a mediocre quality fuel leads to dirtying of the injectors and therefore deteriorates the quality of the fuel jet, which increases the production time for the air/fuel mixture and deteriorates the combustion. The fuel consumption and polluting emissions are thus in particular increased. A fuel may also have a variable composition and intrinsic properties, which will influence its combustion properties, and thus the output of the engine and its polluting emissions.

A fuel may also have fractions that are unstable over time, such as certain fractions of biofuels, these unstable fractions for example deteriorating by oxidation and being able to lead to dirtying of the fuel circulation circuit.

A fuel may also have mediocre properties leading to deterioration or early aging of the equipment of the fuel circulation circuit, for example through lack of lubricating property.

The quantity of additive used may depend on the geographical area in which the vehicle travels, the fuel meeting different standards that are known for each geographical area of the world.

To that end, a GPS chip or any other geolocation means installed at the dispensing device or the GPS of the vehicle makes it possible to locate the area in which the vehicle is traveling and therefore the type of fuel sold in that area. Depending on the identified geographical area, an additional quantity of additive may be dispensed, the injected quantity also being able to depend on the geographical area.

Alternatively, a specific probe intended to analyze the fuel used may be mounted in any location of the fuel circulation circuit and/or in the fuel tank.

This probe may for example include a near infrared (NIR)-type sensor that may for example measure the content level of the biodiesel fraction of the fatty acid methylic ester (FAME) of the diesel fuel. The higher this concentration, the more the fuel is subject to deterioration over time, which risks creating disruptions in the running of the engine, and the more it will be necessary to add additive to stabilize it.

Other types of specific analyses may of course be used, such as the alcoholic compound content, for example the ethanol of the gasoline fuel, the fraction of alcoholic compound modifying the combustion properties of the fuel. Likewise, analyses may make it possible to access the combustion properties of the fuel, such as the hexadecane index for diesel fuels and the octane index for gasoline. These analyses may be generated by the ECU of the vehicle or directly by the dispensing device.

Likewise, the quality of the fuel may be deduced from the parameters of the combustion done in the cylinders of the engine, such as the pinking, the noise from the combustion, or the evolution of the pressure in the cylinders. These data may in particular be recovered from the vehicle's ECU. In fact, certain characteristics of the fuel, such as the hexadecane index, modify the parameters of the combustion: the lower the hexadecane index is, the later the combustion cylinders start, creating a significant pressure increase, which generates noise.

Thus, depending on the obtained results, the quantity of additive to be dispensed will be adapted.

Travel Conditions

The additive concentration may also be adapted based on the travel conditions of the vehicle, travel conditions referring to the urban, road, highway, or mixed travel profile of the vehicle.

These travel conditions are particularly important when the additive used helps to regenerate pollution reduction means positioned in the exhaust line of the vehicle, such as a particle filter. In fact, when the travel profile is of the urban type, the exhaust gases have a lower temperature relative to that encountered during a highway travel profile, that situation being unfavorable to regeneration of the particle filter. Furthermore, the length of urban journeys is generally shorter, which may prevent the total regeneration of the particle filter.

Contrariwise, when the travel profile is of the road or highway type and the speed of the vehicle is high, the temperature of the exhaust gases is higher, which facilitates regeneration of the particle filter. In fact, the temperature deviation between the temperature of the exhaust gases and temperature allowing regeneration of the particle filter is then lower.

Furthermore, for a travel profile of the highway type, the quantity of nitrogen oxides NOx emitted is higher, which is also favorable to regeneration of the particle filter.

Thus, during implementation of this example, the quantity of additive used will be adapted to the travel conditions of the vehicle. More particularly, a large quantity of additive, making it possible to increase the additive concentration in the fuel, will be injected once it is detected that the vehicle is traveling in an urban setting for a predetermined length of time. Conversely, a reduced quantity of additive will be injected when it is detected that the vehicle is traveling in a highway environment for a predetermined length of time.

Likewise, in other cases and depending on the additive to be injected, it may be interesting to increase the additive concentration in the fuel, depending on whether one wishes for the vehicle to have more power, which is in particular the case when the travel profile is of the highway type or under high load conditions, such as in the mountains.

In order to assess the travel conditions of the vehicle, a GPS chip or any other geolocation means installed at the dispensing device or the GPS of the vehicle makes it possible to locate the geographical area in which the vehicle is traveling and therefore determine the travel profile of the vehicle. Furthermore, it is also possible to obtain the average speed of the vehicle from this equipment.

It should be noted that when the GPS, or any other geolocation means, of the vehicle is used, if applicable, the signal corresponding to the anticipated journey may be recovered and the additive needs may then be anticipated.

Likewise, the average speed of the vehicle may be recovered by the onboard computer vehicle. Thus, in the case where the additive is suitable for regeneration of the particle filter, and an average speed below 50 km/h, and more particularly below 30 km/h, is detected, the additive concentration is increased.

It is also possible to use the instantaneous speed of the vehicle, the additive concentration being increased when the instantaneous speed of the vehicle is for example below 50 km/h for more than one hour.

Likewise, the temperature of the exhaust gases may be used, that temperature being recovered from the ECU or directly by a dedicated sensor positioned in the exhaust line of the vehicle.

Thus, when the additive used is adapted for regeneration of the particle filter, an additional quantity of additive may be dispensed when the temperature of the gases is low, in particular when it is below 300° C., and more particularly below 250° C.

Likewise, the fuel consumption of the engine, accessible either by a level sensor in the fuel tank or from the vehicle's ECU, indicates, for a given vehicle, the travel conditions of the vehicle, each vehicle having different consumption ranges for urban/mixed/road use. For a given vehicle, a high consumption is generally associated with urban use. These ranges are known during the design of the vehicle and may be used to adapt the additive concentration.

However, it is preferable to couple this datum with other accessible data representative of the travel conditions of the vehicle, such as the temperature of the exhaust gases. In fact, a high consumption coupled with a low temperature of the exhaust gases, typically below 300° C., is characteristic of urban use, whereas a high consumption associated with a high temperature of the exhaust gases is characteristic of road use or highway use requiring less additive for regeneration of the particle filter.

Likewise, the fluctuation of the pressure in the high-pressure system of the fuel circulation circuit, in particular in the high-pressure pump compressing the fuel or in the single supply ramp of the injectors, may be used to determine the travel conditions of the vehicle.

In fact, certain vehicles have a variable pressure level in the high-pressure part of the circulation circuit. This is in particular the case for vehicles equipped with a so-called "stop and start" or "stop and go" device making it possible to stop and start the engine automatically when it passes the neutral position for example, or for thermal-electric hybrid vehicles for which the heat engine does not operate continuously. Thus, for these vehicles, the recorded pressure, for example provided by the vehicle's ECU, in the high-pressure part of the circulation circuit reduces each time the engine is stopped. Such operations are typically encountered during urban and/or short journeys and may therefore be used to adapt the additive concentration.

Likewise, the air flow rate supplying the combustion chamber of the engine, for example provided by the ECU of the vehicle, may be used to determine the travel conditions of the vehicle.

In fact, for example for diesel engines, the decrease in the air flow rate indicates slowing of the engine and can therefore be associated with urban use. It may then be interesting for vehicles equipped with pollution reduction means of the particle filter type, when those conditions are detected, to increase the additive concentration assisting with regeneration of the particle filter.

Polluting Emissions From the Engine

The additive concentration may also be adapted based on the polluting emissions from the engine, and more particularly based on the evolution of those polluting emissions.

Thus, when an additive assisting with regeneration of pollution reduction means of the particle filter type is used, it is particularly interesting to track the evolution of the emissions of NOx, soot or other carbon particles or the NOx/soot and/or NOx/particle ratios, these different parameters being representative of the polluting emissions resulting from the combustion of the fuel.

For example, when the soot emissions and emissions of other carbon particles increase, and/or when the NOx emissions decrease, and/or when the NOx/soot or NOx/particle ratio decreases, the additive concentration assisting with regeneration of the particle filter may be increased.

These different emissions may be assessed directly through sensors positioned in the exhaust line.

The additive injection may then be controlled by comparing the recovered data and the expected theoretical values.

Thus, a NOx concentration higher than the expected value is a sign of deterioration of the combustion, in which case it may be advantageous to increase the detergent-type additive concentration to improve the combustion properties of the fuel and/or allow better operation of the high-pressure injectors.

It is also possible to recover the combustion parameters of the engine from the vehicle's ECU, then to compare those values to the expected theoretical values so as to define the position of the combustion in the mapping of the engine connecting the speed of rotation of the engine to its torque, each combustion point corresponding to standard emissions defining a map of polluting emissions.

Likewise, when the additive used assists with regeneration of the pollution reduction means, such as a particle filter, the evolution of the pressure drop each time the particle filter is loaded with soot may be monitored so as to determine the carbon particle emission level. In fact, for a given particle filter and for a given exhaust line architecture, an increase in the pressure drop corresponds to an increase in the emissions of carbon particles and can therefore activate dispensing of additives so as to increase the concentration of the latter in the fuel.

Regeneration Quality of the Particle Filter

The additive concentration can also be adapted based on the quality of regeneration of the pollution reduction means of the particle filter type.

This example only relates to additives used to assist with regeneration of pollution reduction means positioned in the exhaust line of the vehicle, such as a particle filter.

Thus, when the preceding regeneration has not gone well, i.e., when the soot contained in the particle filter has not been completely burned, the additive concentration in the fuel is increased so as to favor the following regeneration.

The quality of a regeneration may be evaluated in different ways.

The evolution of the pressure drop during the previous regeneration is a first indicator. Thus, when the pressure drop does not return to the expected baseline, or near that baseline, and there is for example a deviation of at least 5 mbar, and/or it returns slowly, for example in more than 20 minutes, to the baseline, the additive concentration may be increased.

Likewise, the evolution of the properties of the oil lubricating the engine, called engine oil, can be observed.

The quality of the engine oil tends to deteriorate when the regeneration of the particle filter is slower than normal. In fact, a slow regeneration requires late fuel post-injections in the cylinders for a significant length of time so as to keep a high temperature in the particle filter throughout the entire regeneration period. These post-injections or late injections relative to the top dead center in the compression/decompression cycle of the cylinders, driving part of the fuel into the engine oil, lead to the dilution of the engine oil. This dilution causes an increase in the liquid level in the engine oil circuit on the one hand and a deterioration in the properties of the engine oil on the other hand, in particular a modification of its viscosity, its lubricating properties and its acidity. Additionally, the oil may then be contaminated by soot or carbon particles.

Thus, when an increase is detected in the oil level over time and/or a decrease is detected in the quality of the oil over time, the additive concentration may be increased so as to assist with the next regeneration of the particle filter.

The data may be recovered from probes or sensors analyzing the engine oil, and sent directly to the control means controlling the additive injection means or to the ECU of the vehicle connected with said control means.

The means for analyzing the engine oil used may be made up of:

- a sensor detecting the variation of the dielectric constant of the oil, that variation being connected to the deterioration and pollution state by carbonaceous materials such as soot,
- a sensor detecting the viscosity variation of the engine oil, and/or
- a sensor detecting the evolution of the oxidation state and acidity of the oil by checking the corrosion of a metal wire in contact with the oil.

Fifth Control Mode

The purpose of this fifth control mode is to recognize the nature and/or characteristics of the additive contained in the additive tank 26.

Thus, the dispensing of additive may be adapted to account for either the identified additive, or the precise value of certain physicochemical characteristics of the additive lot used.

This control mode thus makes it possible to change the nature and/or characteristics of the additive used during the lifetime of the vehicle, the latter in fact being able to be very changed, for example to improve the performance of an aging engine, or following a modification of a fuel standard in a given geographical area, or when the vehicle changes geographical travel areas, or when modifications have been made to the vehicle, such as the addition of a particle filter.

Furthermore, this control mode makes it possible to adapt precisely to the additives used, the latter being able to have a variable viscosity, density and/or concentration from one lot to another.

In the latter case, the tank containing the additive, in particular when it is in the form of a pouch, may be equipped with an information system of the barcode type making it possible to send information, and the dispensing device may be equipped with means making it possible to read the information.

Thus, depending on the information collected by the dispensing device, the opening frequency and/or duration of the closing off means allowing dispensing of the additive are recalculated so as to deliver the desired quantity of active elements in the fuel.

Of course, the different control modes described above as examples are in no way limiting, and other parameters may be used making it possible to analyze the use of the vehicle and/or the travel conditions of the vehicle and/or the evolution of the quantity of fuel contained in the fuel tank and/or the fuel quality and/or the polluting emissions resulting from the combustion of the fuel in the engine and/or the quality of the regeneration of pollution reduction means positioned in the exhaust line of the engine and/or the type of additive used and/or the evolution of the additive flow rate dispensed in the fuel circulation circuit.

Furthermore, as previously mentioned, different control examples may be combined with each other.

Likewise, several additives each stored in independent tanks can be dispensed in the circulation circuit using the dispensing device according to the invention, each additive being able to be injected according to an example embodiment previously described. The selection of the additives is done by one skilled in the art for example taking into account the geographical area in which the vehicle is marketed, the quality of the fuel available in that geographical area, in particular the presence of any biofuels in that area, or atmospheric conditions encountered in that area.

The choice of additives may also be made in light of regulations regulating the maximum levels of polluting emissions in that same area. In areas where the particle filter is required to comply with the antipollution standards on such emissions, an additive will advantageously be incorporated suitable for assisting with regeneration of the particle filter.

The choice of the composition of the additive may also be made based on the engine technology of the vehicle, such as the nature and the design of the high-pressure fuel injectors, the type of fuel filter, or the pressure available in the high-pressure ramp supplying each of the injectors with pressurized fuel.

The choice of the additive(s) may also be made based on the mapping of the polluting emissions from the engine.

Additives

The different additives that may be used by the dispensing device according to the invention will now be described in more detail, these additives being known and widespread in the automobile field.

As previously indicated during the description of the different control modes, some additives are more particularly concerned by the previously described examples.

These additives, which will now be described, may be classified in two categories: on the one hand, those with a catalytic function assisting with regeneration of the particle filter, and on the other hand, those which have a function other than a catalytic function.

The additives used generally assume a liquid form and can be made up of a liquid or mixture of liquids, a colloidal suspension in a liquid base, or in the form of a gel whereof the viscosity allows the flow of the additive.

Additives Assisting With Regeneration

These additives are ideally liquids in the operating temperature range, generally comprised between 20 and 45° C., but they may also as sume another physical form, such as a gel.

These additives may contain any type of catalyst effective to catalyze the combustion of soot, in particular platinum, strontium, sodium, manganese, cerium, iron and/or combinations thereof.

The quantity of additive necessary in the fuel is generally at least approximately 1 ppm and at most approximately 100 ppm, this quantity being expressed in mass of metallic additive element relative to the mass of fuel.

These additives may assume the form of an organometallic salt or a mixture of organometallic salts that are soluble or dispersible in the fuel. The salts are characterized in that they comprise at least one metallic part and one complexing organic part generally of acid origin, all suspended in a solvent.

The FBC additives may also assume the form of an organometallic complex or a mixture of organometallic complexes that are soluble or dispersible in the fuel. These complexes are characterized in that they comprise at least one metallic part and at least two complexing organic parts. Such a product is for example described in GB 2,254,610.

Additionally, the FBC additives may also assume the form of a colloidal suspension or dispersion of nanoparticles, for example of amorphous or crystallized oxide or metal oxyhydroxide.

In the present description, the expression "colloidal dispersion" designates any system made up of fine solid particles with colloidal dimensions with a base of the additive, suspended in a liquid phase, said particles further optionally being able to contain residual quantities of bonded or adsorbed ions, for example such as nitrates, acetate, citrates, ammoniums or chlorides. Colloidal dimensions are dimensions comprised between approximately 1 nm and approximately 500 nm. These particles can more particularly have an average size of at most 100 nm, and more particularly at most 20 nm.

In the case of FBC additives in the form of a colloidal dispersion, the particles may have a base of a rare earth and/or a metal chosen from groups IIA, IVA, VIIA, VII, IB, IIB, IIIB and IVB of the periodic table.

A rare earth refers to an element from the group made up of yttrium and elements of the periodic table with an atomic number comprised between 57 and 71, inclusively.

The periodic table of elements to which reference is made is that published in the Supplement to the Bulletin of the French Chemical Society no. 1 (January 1966).

For these additives that may be used in the form of a colloidal dispersion, the rare earth may more particularly be chosen from among cerium, lanthane, yttrium, neodyme, gadolinium and praseodyme. Cerium may particularly be chosen. The metal may be chosen from among zirconium, iron, copper, gallium, palladium and manganese. Iron may more particularly be chosen. The iron may assume the form of an amorphous or crystallized compound.

Mention may more particularly also be made of colloidal dispersions with a base of a combination of cerium and iron.

The colloidal dispersions may more particularly comprise:

an organic phase, particles of the additive, of the type described above (in particular rare earth and/or a metal chosen from groups IIA, IVA, VIIA, VIII, IB, IIB, IIIB and IVB), suspended in the organic phase;

at least one amphiphilic agent.

These colloidal dispersions may in particular contain an additive with a base of iron or an iron compound.

The colloidal dispersions may assume forms according to different embodiments described in particular in the following patent applications: EP 671,205, WO 97/19022, WO 01/10545, WO 03/053560, WO 2008/116550.

Other Additives

Other known types of additives different from FBCs and which have a function other than a catalytic function may also be injected into the circulation circuit. These additives make it possible to improve the dispensing of the fuel in the engine and/or to improve the running performance of the engine and/or also to improve the running stability of the engine.

Additives for improving the dispensing fuel in the engine for example include anti-foaming additives, such as organosilicones, deicing additives, such as alcohols with a low molecular weight or glycols.

Other additives are those improving the cold running of the engine. These include polymeric additives reducing the temperature at which the fuel is reaches its cloud point or solidifies, additives favoring flow, such as polymers with a high molecular weight to reduce the turbulence in the fluids and also increase the flow rate by 20 to 40%.

Corrosion inhibiting additives may also be used.

Additives improving the running performance of the engines may also be used, such as pro-hexadecane additives, pro-octane additives, fume inhibiting additives, additives reducing friction losses called friction modifiers (FM), or extreme pressure additives.

Detergent additives, designed to limit any deposits at the injectors, can also be used. The fuel may in fact form deposits in the fuel circuit, in particular at the high-pressure fuel injectors and more particularly at the holes of the injectors. The amplitude of the formation of the deposit varies with the design of the engine, in particular the characteristics of the injectors, the composition of the fuel and the composition of the oil used to lubricate the engine. Furthermore, these detergents are also effective to reduce the negative impact of the presence of metal compounds in fuels such as the Zn or Cu that may come from contamination for example of the fuel dispensing system or traces of compounds coming from the synthesis method for the fatty acid esters.

Excessive deposits may modify the aerodynamics, for instance, of the fuel jet coming from the injector, which in turn may hinder the air-fuel mixture. In certain cases, this results in excess fuel consumption, power loss of the engine, and increased polluting emissions.

The detergent additives have the particularity of dissolving already-formed deposits and reducing the formation of deposit precursors, so as to avoid the formation of new deposits. One example of a detergent additive is for example described in WO 2010/150040.

Additives improving the lubricating power may also be used to avoid the wear or seizing of the high-pressure pumps in particular as well as the injectors, the lubricant power of the fuels being mediocre. They contain a polar group that is attracted by the metal surfaces to form a protective film on the surface.

Additives improving the running stability of the engine may also be considered. Instability of the fuels causes gums to form that participate in dirtying the injectors, clogging the fuel filter and dirtying the pumps and the injection system.

The following additives may also be used:

antioxidant-type additives;

stabilizer additives;

additives deactivating metals aiming to neutralize the catalytic effects of certain metals;

dispersive agents aiming to disperse the formed particles and prevent the agglomeration of fairly large particles.

According to one particular embodiment, the additive is a combination of a detergent additive and a lubricant additive, and optionally a corrosion inhibiting additive.

In the case of a vehicle equipped with a particle filter, it is advantageous to combine an FBC-type additive with at least one fuel performance additive of the detergent type as described in patent application WO 2010/150040.

In the case of a vehicle equipped with a particle filter, it is also advantageous to combine an FBC-type additive with several fuel performance additives, in particular when the vehicle is marketed in a geographical area where the fuel is of variable and/or mediocre quality.

In the case of a vehicle not equipped with a particle filter, different types of combinations of additives may be considered, for example combining one or more detergents with a lubricating additive and a corrosion inhibitor.

The invention claimed is:

1. A device for dispensing a liquid additive in a fuel circulation circuit for an internal combustion engine equipping a vehicle, said device comprising:

a tank containing the liquid additive, an enclosure communicating with the fuel circulation circuit and inside which the tank containing the additive is inserted, at least one movable sealing wall between said enclosure and said tank providing a sealing separation and maintaining an identical pressure between the additive in the tank and the fuel in the enclosure, an injector connected to the tank and the fuel circulation circuit and making it possible to dispense the liquid additive in the fuel circulation circuit, said injector including a dispensing channel connecting the tank and the fuel circulation circuit, and a controller of the injector, further comprising pressure sensors measuring the pressure at an additive dispensing orifice positioned at one end of the dispensing channel situated at the fuel circulation circuit, and at an inlet orifice for the fuel positioned upstream from the dispensing orifice in the circulation circuit, a pressure difference between the orifices constituting a parameter representative of the use of the vehicle or the evolution of the additive flow rate or the travel conditions, the controller being associated with:

an analyzer of at least one parameter representative of the use of the vehicle; or an analyzer of the travel conditions of vehicle, or an analyzer of the evolution of the quantity of fuel contained in a fuel tank, said tank being accessible to a user so as to add fuel, and/or an analyzer of the quality of the fuel, and/or an analyzer of the polluting emissions resulting from the combustion of the fuel in the engine and/or an analyzer of the quality of the regeneration of a particle filter positioned in the exhaust line of the engine, and/or an analyzer of the type of additive used, and/or an analyzer of the evolution of the additive flow rate dispensed in the fuel circulation circuit, and/or an analyzer of climate conditions, to monitor the operation of the injector.

2. The dispensing device according to claim 1 wherein the injector includes a valve for closing off the dispensing channel, the valve being suitable for completely or partially closing off the dispensing channel.

3. The dispensing device according to claim 1 further including a temperature sensor intended to indicate the temperature of the fuel in the fuel circulation circuit, in particular near the dispensing channel, or of the additive, the temperature of the additive or the fuel constituting a parameter representative of the evolution of the additive flow rate or the use of the vehicle or climate conditions.

4. The dispensing device according to claim 1 further including a temperature sensor outside the vehicle, the outside temperature constituting a parameter representative the climate conditions.

5. The dispensing device according to claim 1 further including a sensor detecting the turning on of the vehicle or an element belonging to the fuel circulation circuit, the turning on constituting a parameter representative of the use of the vehicle.

6. The dispensing device according to claim 1 further including a noise sensor positioned near the engine, the detection of noise by the sensor constituting a parameter representative of the use of the vehicle.

7. The dispensing device according to claim 1 further including a GPS system or a movement sensor, the detection of movement by the location means or the movement sensor constituting a parameter representative of the use of the vehicle or the travel conditions of the vehicle.

8. The dispensing device according to claim 1 wherein the average speed or instantaneous speed of the vehicle constitutes a parameter representative of the travel conditions of the vehicle.

9. The dispensing device according to claim 1 wherein the temperature of the exhaust gases constitutes a parameter representative of the travel conditions of the vehicle.

10. The dispensing device according to claim 1, wherein the evolution of the pressure in the circulation circuit, in particular in a high-pressure circuit of the vehicle made up of a high-pressure pump and a shared injection ramp, constitutes a parameter representative of the travel conditions of the vehicle.

11. The dispensing device according to claim 1, wherein the evolution of the air flow rate supplying the combustion chamber of the engine constitutes a parameter representative of the travel conditions of the vehicle.

12. The dispensing device according to claim 1, wherein the evolution of the fuel flow rate in the circulation circuit constitutes a parameter representative of the evolution of the additive flow rate.

13. The dispensing device according to claim 1, wherein the evolution of the emissions of NOx, soot or other carbon particles or the NOx/soot or NOx/particle ratios constitute parameters representative of the polluting emissions resulting from the combustion of the fuel.

14. The dispensing device according to claim 1, wherein the evolution of the quality or quantity of oil allowing lubrication of the engine constitutes a parameter representative of the evolution of the quality of the regeneration of the particle filter positioned in the exhaust line of the engine.

15. The dispensing device according to claim 1, wherein it includes GPS system indicating the geographical area in which the vehicle is located, the location of the vehicle provided by the location system constituting a parameter representative of the quality of the fuel marketed in the geographical area.

16. The dispensing device according to claim 1, wherein the parameters representative of the combustion of the fuel in the cylinders of the engine constitute a parameter representative of the quality of the fuel.

17. The dispensing device according to claim 1, wherein the fuel consumption of the engine constitutes a parameter representative of the travel conditions of the vehicle.

18. The dispensing device according to claim 1, wherein the additive may be a particle filter regenerating additive with a base of a rare earth or a metal chosen from groups IIA, IVA, VIIA, VIII, IB, IIB, IIIB and IVB of the periodic table.

19. The dispensing device according to claim 18, wherein the additive assumes the form of a colloidal dispersion.

20. The dispensing device according to claim 19, wherein the particles of the colloidal dispersion have a base of cerium or iron.

21. The dispensing device according to claim 18, wherein the additive is a combination of a colloidal particle dispersion that includes an organic phase and at least one amphiphilic agent and a detergent.

22. The dispensing device according to claim 1, wherein the additive is an additive allowing the improvement of the dispensing of fuel in the engine or the improvement of the running performance of the engine or the improvement of the running stability of the engine.

23. The dispensing device according to claim 22, wherein the additive is a combination of a detergent additive and a lubrication additive.

24. A motor vehicle comprising:

a fuel circulation circuit for an internal combustion engine of the vehicle, and a dispensing device according to claim 1 for injecting the liquid additive in the fuel circulation circuit.

25. A method for using a dispensing device according to claim 1, comprising using the dispensing device for injecting the liquid additive in the fuel circulation circuit, wherein the dispensing of the liquid additive is stopped when the engine of the vehicle is no longer running or when the vehicle is stopped.

26. A method for using a dispensing device according to claim 2, comprising using the dispensing device for injecting the liquid additive in the fuel circulation circuit, wherein the additive dispensing is activated when the valve is powered on.

27. A method for using a dispensing device according to claim 1, comprising using the dispensing device for injecting the liquid additive in the fuel circulation circuit, wherein the dispensing of additive is activated when a pressure difference greater than 2 mbar is measured between the additive dispensing orifice positioned at one end of the dispensing channel and the fuel inlet orifice positioned upstream in the circulation circuit on the other hand.

28. A method for using a dispensing device according to claim 3, comprising using the dispensing device for injecting the liquid additive in the fuel circulation circuit, wherein the additive dispensing is activated when the temperature of the fuel circulating in the circulation circuit or of the additive is above a threshold value representative of a running engine, for example greater than 15° C.

29. A method for using a dispensing device according to claim 3, comprising using the dispensing device for injecting the liquid additive in the fuel circulation circuit, wherein the additive dispensing is stopped when the outside temperature or the temperature of the additive or the temperature of the fuel in the fuel circulation circuit are below a minimum threshold temperature or above a maximum threshold temperature, said minimum and maximum threshold temperatures being defined for a given additive, the minimum threshold temperature being able to correspond to a value for which the viscosity of the additive reaches a threshold value and the maximum threshold temperature being able to correspond to the vaporization value of the additive.

30. A method for using a dispensing device according to claim 2, comprising using the dispensing device for injecting the liquid additive in the fuel circulation circuit, wherein the injection is discontinuous and in that the frequency or opening time of the valve or the solenoid valve type depends on information collected by the controller, the dispensing of additive being done so as to preserve a constant additive concentration in the fuel or to inject the additive in the fuel circulation circuit only when necessary.

31. The method according to claim 30, wherein the dispensing frequency or the dispensing duration of the additives depend either on the usage time of the vehicle or on the number of kilometers traveled by the vehicle or the fuel consumption of the vehicle.

32. The method according to claim 3, comprising using the dispensing device for injecting the liquid additive in the fuel circulation circuit, wherein the frequency or duration of additive dispensing depend on the temperature of the fuel or the additive, or on the pressure between the additive dispensing orifice positioned at one end of the dispensing channel and the fuel inlet orifice positioned upstream in the circulation circuit.

33. A method for using a dispensing device according to claim 1, comprising using the dispensing device for injecting the liquid additive in the fuel circulation circuit, wherein the additive is injected each time fuel is added in the fuel tank, the volume of said additive being able to be fixed or variable, the variable volume being determined based on the quantity of fuel added.

34. A method for using a dispensing device according to claim 1, comprising using the dispensing device for injecting the liquid additive in the fuel circulation circuit, wherein the additive is injected when the analysis of the polluting emissions resulting from the combustion of the fuel indicates that the gases or particles emitted diverge from the theoretical expected value.

35. A method for using a dispensing device according to claim 1, comprising using the dispensing device for injecting the liquid additive in the fuel circulation circuit, wherein the additive is injected before regenerating the particle filter.

36. A method for using a dispensing device according to claim 1, comprising using the dispensing device for injecting the liquid additive in the fuel circulation circuit, wherein an additional quantity of additive is injected before the regeneration of the particle filter when the previous regeneration was not of good quality.

37. The dispensing device according to claim 5 wherein the element belonging to the fuel circuit is a fuel filter.

* * * * *